US008584392B1

(12) United States Patent
Young

(10) Patent No.: US 8,584,392 B1
(45) Date of Patent: Nov. 19, 2013

(54) WEAPON MOUNTED LIGHT

(75) Inventor: Hunter A. Young, Troutville, VA (US)

(73) Assignee: CQ Innovations, Inc., Troutville, VA (US)

( * ) Notice: Subject to any disclaimer, the term of this patent is extended or adjusted under 35 U.S.C. 154(b) by 82 days.

(21) Appl. No.: 13/107,852

(22) Filed: May 13, 2011

Related U.S. Application Data

(60) Provisional application No. 61/334,476, filed on May 13, 2010.

(51) Int. Cl.
*F41G 1/00* (2006.01)

(52) U.S. Cl.
USPC ..... 42/114; 42/131; 42/146

(58) Field of Classification Search
USPC ..... 42/114, 131, 146
See application file for complete search history.

(56) References Cited

U.S. PATENT DOCUMENTS

| | | | | |
|---|---|---|---|---|
| 4,949,231 | A * | 8/1990 | Wang | 362/206 |
| 5,289,082 | A * | 2/1994 | Komoto | 313/500 |
| 5,430,967 | A | 7/1995 | Woodman, III et al. | |
| 5,685,105 | A | 11/1997 | Teetzel | |
| 6,250,771 | B1 * | 6/2001 | Sharrah et al. | 362/184 |
| 6,526,688 | B1 | 3/2003 | Danielson et al. | |
| 6,574,901 | B1 | 6/2003 | Solinsky et al. | |
| 6,578,311 | B2 | 6/2003 | Danielson et al. | |
| 6,675,521 | B1 * | 1/2004 | Kim | 42/114 |
| 6,979,104 | B2 * | 12/2005 | Brass et al. | 362/231 |
| 7,076,908 | B2 | 7/2006 | Kim | |
| 7,117,624 | B2 | 10/2006 | Kim | |
| 7,188,978 | B2 | 3/2007 | Sharrah et al. | |
| D548,385 | S | 8/2007 | Sharrah et al. | |
| 7,310,903 | B2 | 12/2007 | Kim | |
| 7,325,352 | B2 | 2/2008 | Matthews et al. | |
| 7,360,333 | B2 * | 4/2008 | Kim | 42/85 |
| 7,421,817 | B2 | 9/2008 | Larsson | |
| 7,523,583 | B2 | 4/2009 | Cheng | |
| 7,866,082 | B2 * | 1/2011 | Eisenberg et al. | 42/131 |
| 7,954,273 | B1 * | 6/2011 | Swan | 42/115 |
| 2004/0055202 | A1 * | 3/2004 | Oz | 42/146 |
| 2007/0039226 | A1 * | 2/2007 | Stokes | 42/146 |
| 2007/0181114 | A1 * | 8/2007 | Tippmann et al. | 124/71 |
| 2007/0227056 | A1 * | 10/2007 | Howe et al. | 42/146 |
| 2007/0277422 | A1 * | 12/2007 | Ding | 42/146 |
| 2008/0134562 | A1 * | 6/2008 | Teetzel | 42/146 |
| 2008/0209789 | A1 | 9/2008 | Oz | |
| 2009/0009987 | A1 * | 1/2009 | Graham | 362/110 |
| 2009/0122527 | A1 | 5/2009 | Galli | |
| 2010/0254135 | A1 * | 10/2010 | Bayat et al. | 362/235 |
| 2012/0131840 | A1 * | 5/2012 | Toole | 42/114 |
| 2012/0216440 | A1 * | 8/2012 | Riley et al. | 42/146 |

* cited by examiner

*Primary Examiner* — Michelle Clement
(74) *Attorney, Agent, or Firm* — Rhodes IP PLC; Christopher R Rhodes

(57) ABSTRACT

A weapon mounted light for affixing to a weapon has a bulb-reflector assembly cap with at least one light source, and a reflector conformed to direct a beam of light generated by the at least one light source in which the beam generated encompasses a broad area outside of the targeting line to illuminate a broad circular or oblong area encompassing both the target zone and opposing sides thereof.

5 Claims, 10 Drawing Sheets

FIG. 16A
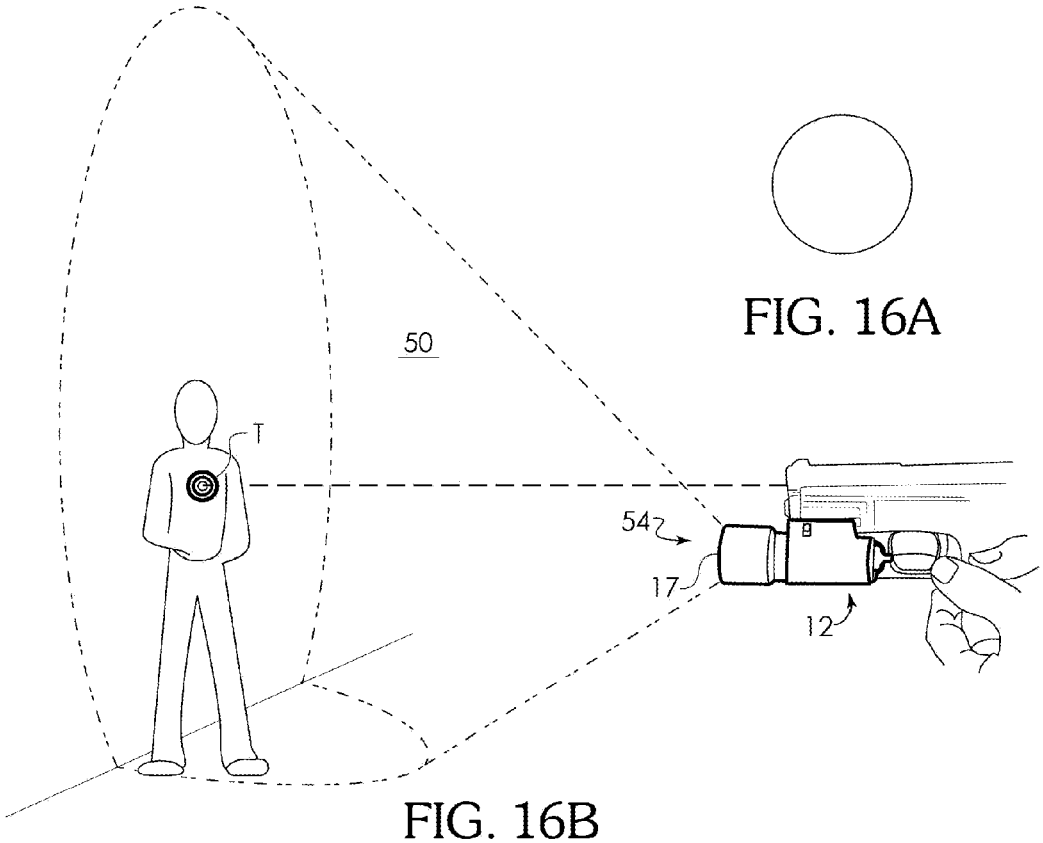
FIG. 16B
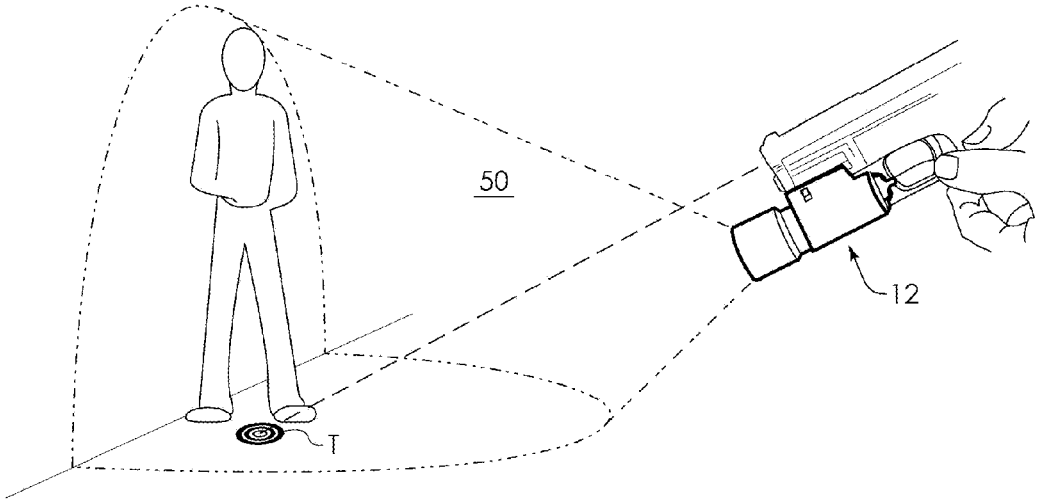
FIG. 17

WEAPON MOUNTED LIGHT

RELATED APPLICATIONS

This application claims the benefit of U.S. Provisional Application Ser. No. 61/334,476 entitled "Weapon Mounted Light" filed on 13 May 2010, the contents of which are incorporated herein by reference in its entirety.

BACKGROUND OF THE INVENTION

The present invention is related to accessories mounted to weapons, and more particularly, to weapon mounted lights. Known weapon mounted lights do not permit illuminating areas adjacent to, or outside of, the line of sight of the barrel of the weapon. In fact, known weapon mounted lights are invariably pointed at the same thing as the weapon, which may be undesirable if the light is to be pointed at something that is not a target of the weapon. Conventional weapon mounted lights illuminate in the same direction in which the weapon is pointed with a relatively narrow conventional beam of light designed to solely illuminate the immediate target area.

The normal human response toward a potential threat is to want to see it as clearly as possible. Existing weapon mounted lights, which contain only narrow illumination beams, have the most intense portion of the light beam parallel with the weapon's barrel. This necessitates that the best lit area is also the general location that a bullet would strike if the weapon were discharged. On the other hand, it is almost universally undesirable to point a weapon at something you do not intend to shoot.

Weapon mounted lights are often used for searching or clearing activities, when the intent to shoot does not exist or has not yet been determined. The human mind has a tendency to center an object being observed within its field of view. This also holds true for centering objects being viewed within the narrow circular beam of a flashlight.

Since existing weapon mounted lights have the brightest portion of their beams parallel with the weapon's barrel, this has traditionally meant that the user's tendency is to instinctively point the weapon directly at whatever is being illuminated, even if there was no desire to actually discharge the weapon. This could cause accidental shootings, especially in high stress situations. Intense and frequent training can assist in overcoming this tendency, but such training is very rare for both law enforcement and civilians. It is therefore desirable to create weapon mounted lights which compensate for both human nature, lack of training, and the existing deficiencies in weapon mounted lights, by illuminating a broader area.

U.S. Pat. No. 6,675,521 issued to Kim on Jan. 13, 2004 shows an attachment for a firearm which slidably engages a railing and has an adjustable flashlight head attached thereto. The device of Kim may be positioned along the side of a barrel and has a head that is adjustable while still maintaining a forward focus of the light beam. U.S. Pat. No. 7,421,817 issued to Larsson on Sep. 9, 2008 teaches a gun accessory mounting device. The device of Larsson has a mounting device which allows a flashlight to be mounted to a handgun in a position in front of the trigger. The mounting device appears to permit an entire flashlight to be pivoted at a point adjacent the front of the trigger to engage an attachment mechanism. This device does not provide for a broad beam and does not show a rotating head flashlight.

U.S. Patent Application Publication No. US 2008/0209789 shows an accessory mount that pivots laterally along the line of the barrel, but does not illuminate a broad area including the areas at an angle to the barrel. U.S. Pat. No. 7,117,624 teaches accessory devices for firearms that includes a light, which is slidably engaged on a rail along the bottom of the forearm of a shotgun, and has a rotatable accessory disposed thereon.

Several patent references involve firearms, including hand guns, with flashlights or laser sights slidably engaged on a rail or ridges disposed under the barrel, adjacent the trigger. U.S. Patent Application Publication No. US 2009/0122527 shows a flashlight having an outer housing that fits on the rails of a firearm, such as a machine gun. U.S. Pat. No. 7,523,583 shows a gun accessory that will mate with the bottom of the frame of a handgun for holding a flashlight accessory. U.S. Pat. No. 7,360,333 shows accessory devices for firearms including a below the barrel along the rail flashlight mount. U.S. Pat. No. 5,685,105 shows an apparatus for attaching a flashlight to a firearm. U.S. Pat. No. 5,430,967 shows an aiming assistance device for a weapon disposed on a rail under the barrel.

U.S. Pat. No. 7,325,352 also shows accessory devices for firearms below the barrel and along a frame mounted rail at the bottom of the barrel. U.S. Pat. No. 7,310,903 teaches accessory devices for firearms that include a light in a housing slidably engageable with a rail along the bottom of a firearm. U.S. Design Pat. No. D548,385 shows a firearm flashlight that is mountable to a rail below the barrel. U.S. Pat. Nos. 7,076,908, and 6,571,503 show an accessory mount for a firearm holding or designed to hold a flashlight or similar light. A disadvantage of the prior art expressed in U.S. Pat. No. 6,574,901, which shows an accessory mount for a firearm, is that if the device is left mounted on the weapon, it cannot be used independently of the weapon despite the fact that in some situations, it is desirable to illuminate an area without pointing the weapon directly toward that area.

U.S. Pat. Nos. 6,578,311 and 6,526,688 teach an apparatus and method for actuating a weapon accessory by a laser sighting beam which also shows a light under the barrel and disposed along a rail. Chinese Patent No. CN101416019 shows an under barrel sighting device which uses button batteries. Canadian Patent No. CA2650892 shows another under barrel flashlight device. U.S. Pat. No. 7,188,978 shows a light mountable on a mounting rail.

These references do not show a weapon mounted light that can be rotated, nor do they show a weapon mounted light which can illuminate in a broader direction in order to illuminate areas adjacent or sideways of the path of the barrel of the weapon pointing at the target zone. All known devices, when fully mounted, point along the barrel at the target of the weapon to illuminate the target zone and the immediate adjacent area centering on the target. A weapon mounted light that illuminates in a direction broader than the target zone is desirable. Further, a weapon mounted light that illuminates both the target zone and an area along a predetermined or adjustable angle from the barrel of the weapon is also desirable.

SUMMARY OF THE INVENTION

The present invention is a light, such as a flashlight, mounted on, or adjacent to, the barrel of a firearm, that has a broad beam to illuminate at an angle to both sides of the target. The mounted flashlight permits the light to encompass adjacent areas, above/below and/or to both sides, to the line of the barrel in which the target lies. The light is mounted to the weapon via a rail, a trigger guard, or the like, and may be disposed along the bottom, the top, or sides of the barrel. An alternative embodiment of the present invention includes multiple facets of light allowing the illumination of the target zone, and an area at an angle from the barrel to illuminate an area not in the target zone, either above/below or a broader area. A laser target sight, or an alternative aiming device, may be provided integrally attached to the weapon mounted light or as an accessory thereto.

An aspect of the present invention is to allow the user to adequately illuminate an area using a weapon mounted light without the weapon necessarily pointing at the area being illuminated, but also allowing the area targeted to be illuminated at the same time.

The light illuminates areas not within the target zone of the weapon making the light more useful and safer as a flashlight, and for search and rescue.

Another aspect of the present invention is to create a large area of consistent illumination. This may be accomplished with multiple bulbs meant to create a circular pattern or with multiple bulbs meant to create a pattern or geometric shape such as a rectangle. It could also be accomplished by a single bulb with a specially designed reflector or lens to create a broad beam or an oblong beam.

A further advantage of the present design is that it permits selective adjustment of the beam to produce a circular beam or an oblong beam.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

FIG. 16A is a thumbnail showing the basic shape of the beam shown in FIGS. 16B and 17.

FIG. 16B is an environmental view of a weapon mounted light according to an embodiment of the present design in which the beam is circular.

FIG. 17 is another environmental view of a weapon mounted light according to an embodiment of the present design demonstrating that the beam illuminates outside of the target zone.

FIG. 24 shows the bulb of FIG. 24 as viewed from a 90 degree rotation from the view in FIG. 21 to show that the reflector is squeezed along one view from the sides producing the oblong beam.

Similar reference characters denote corresponding features consistently throughout the attached drawings.

DETAILED DESCRIPTION OF PREFERRED EMBODIMENTS

Figure 1:
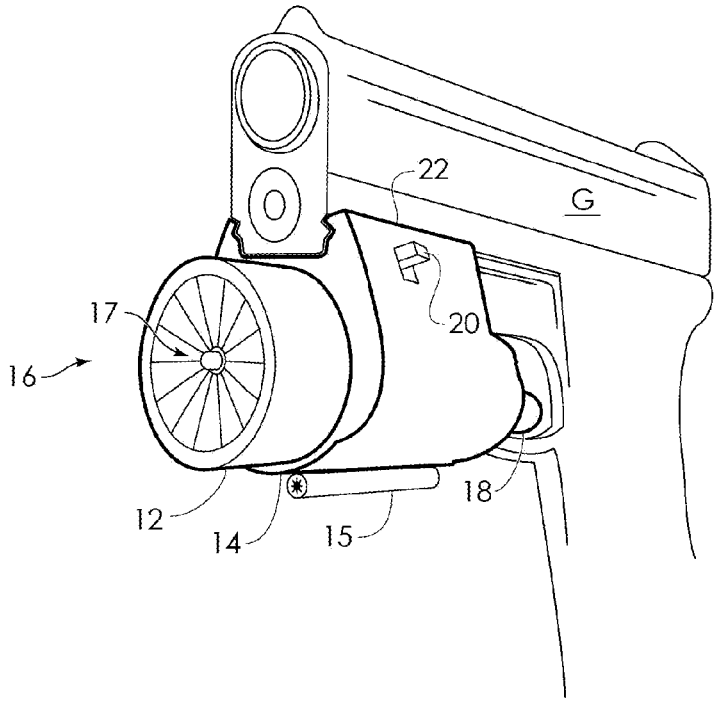
FIG. 1 is an environmental perspective view of a weapon mounted light according to an embodiment of the present design.

A weapon mounted light 12 is affixed to a weapon G, as shown in FIG. 1, in which the weapon has a bore disposed along a targeting line T of the weapon G. A bulb-reflector assembly cap 16 has at least one light source 17, and a reflector 56 conformed to direct a beam of light 50 generated by the at least one light source 17 in which the beam generated 50 encompasses a broad area outside of the line of the target T. The weapon mounted light 12 of the present design permits a broad beam of light 50 to be directed at an area that includes an area in addition to the target T and at opposing angles thereto in order to illuminate an oblong or circular region that encompasses the target T. An oblong shape has a length greater than its width, and especially refers to a rectangle or distorted circle. The beam 50 generated illuminates an oblong area encompassing both the target zone and opposing sides thereof.

The term "reflector" as used herein includes conventional reflectors and lenses using conventional light sources, but also encompasses newer lenses that utilize the total internal reflection and secondary optics which are available from Cree, Inc. of Durham, N.C., or other suppliers. The term "bulb" as used herein includes light emitters or other light source as is well known in the art of flashlights.

Figure 2:
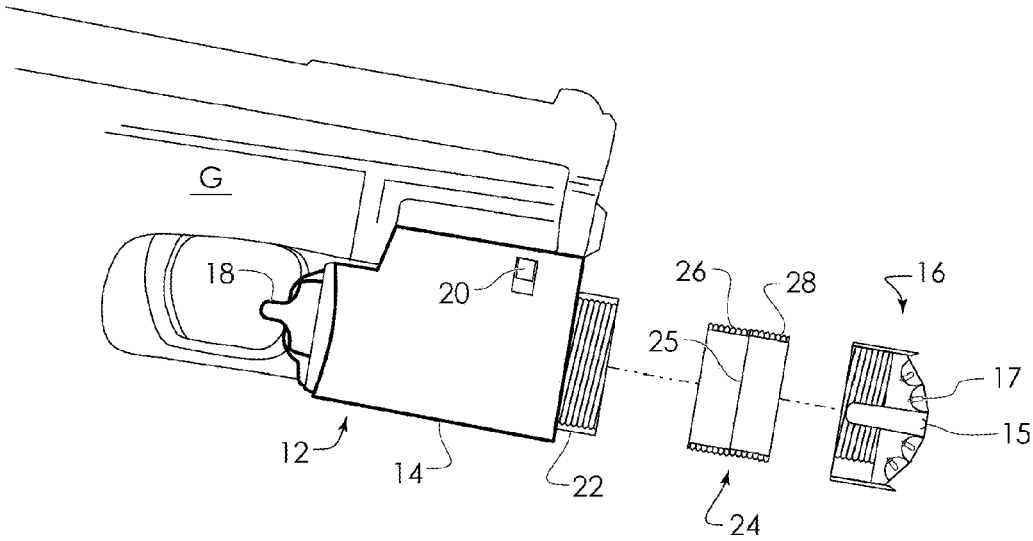
FIG. 2 is a side view of an alternative embodiment of a weapon mounted light according to the present design including a cross sectional cutaway view showing alternative connectors for attaching a light bulb assembly to the weapon mounted light base attached to a weapon.
Figure 3:
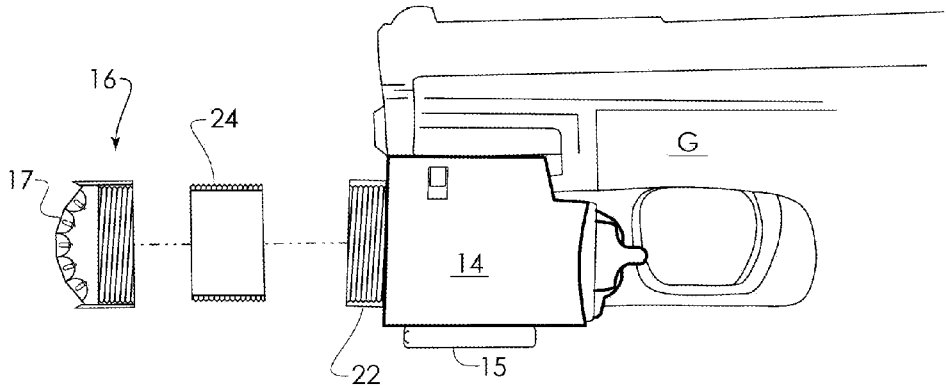
FIG. 3 is another alternative embodiment of a weapon mounted light according to the present design including a cross sectional cutaway side view of a light bulb assembly of the weapon mounted light in which both the base and the light bulb assembly have inner treads and a connector has outer threads that mate with both base and bulb assembly.

The light 12 is mounted to the weapon G via a rail, a trigger guard, an adaptor, or the like, as is well known in the art, which is shown in FIGS. 1-3. The light 12 may be disposed along the bottom, the top, or to the side of the weapon G, as is also well known in the art. FIGS. 2-6 show different arrangements in which the bulb-reflector assembly 16 is attached to the base 14. FIGS. 7-15 demonstrate various configurations of the design of the bulb-reflector assembly 16. The beam of light 50 is directed along the barrel to illuminate the target zone T, and also illuminates some of the area adjacent the target zone T, as shown in FIGS. 16A-19B. A laser target sight 15 may be provided integrally attached to the weapon mounted light 12, or as an accessory thereto (not shown), as is well known in the art. Alternatively, a laser target sight 15 may be provided in the bulb-reflector assembly 16. High intensity beams 50, strobe lights, and/or bulbs 17 or jells with at least two color lights are alternatives of the present design. The at least one light source has a high intensity light, a strobe effect, at least two different colored beams, or combinations thereof.

Although the present invention is described attached to a hand gun G, it is not limited to that embodiment. The present invention may be used with a variety of hand held or mounted weapons including rifles, shot guns, pistols, revolvers, machine guns, and the like. Different LED colors, which may be used with the present invention, behave differently under different illumination situations. Various light wavelengths may be desirable for different situations. For example, some wavelengths penetrate smoke more effectively than others, and LEDs designed to emit those wavelengths may be desirable. Multiple LED light bulbs may be provided with different colors or the ability to change the colors of the light beams. Similarly, high intensity weapon mounted lights are useful for blinding and disorienting a potential threat. A strobe action may also be provided.

With a rotatable head the beam, of the present invention, can be rotated. Another approach could be many smaller bulbs, LEDs, etc. arrayed to evenly illuminate a large area. This has the potential to create the most desirable and safest situation. It is to be understood that the present invention may make use of different wavelength of light for use with night vision, or other circumstances, which wavelength of light may or may not be visible to the naked eye.

The preferred design of the weapon mounted light 12 generates an oblong or circular shaped beam of light 50 to illuminate a wide area. The oblong shaped beam can be oval or rectangular shaped. A rectangle, ellipse, or other non-circular shape may be useful because it would concentrate the unit's light into a shape most advantageous for the user. For instance, the user may wish to thoroughly illuminate a subject without pointing the weapon at the subject. If a rectangular beam 50 having substantially equal intensity throughout its length is used, then it may be pointed vertically approximately from floor to ceiling. This enables the user to hold the weapon downward at an angle while still adequately illuminating the subject. Furthermore, the light is also useful for clearing narrow and dangerous areas such as stairwells, when adjusted vertically. The non-circular embodiments may be adjusted to any angle centering on the target zone.

The base 14 removably attachable to a gun G which engages and holds the bulb-reflector cap assembly 16 in position. FIG. 2 is a side view of an alternative embodiment of a weapon mounted light according to the present design attaching a light bulb assembly 16 to the weapon mounted light base 14 attached to a weapon G. An adapter 24 may be disposed between the cap 16 and the base 14 to mate the cap 16 with the base 14. The cap 16 may have female threads, and the base 14 may also have female threads in the cap receptor 22. An adapter 24 disposed between the cap 16 and base 14 may have two different threads 26 and 28 for engaging the base 14 and the cap 16, with an intersection 25 between the different threads 26 and 28.

Figure 4:
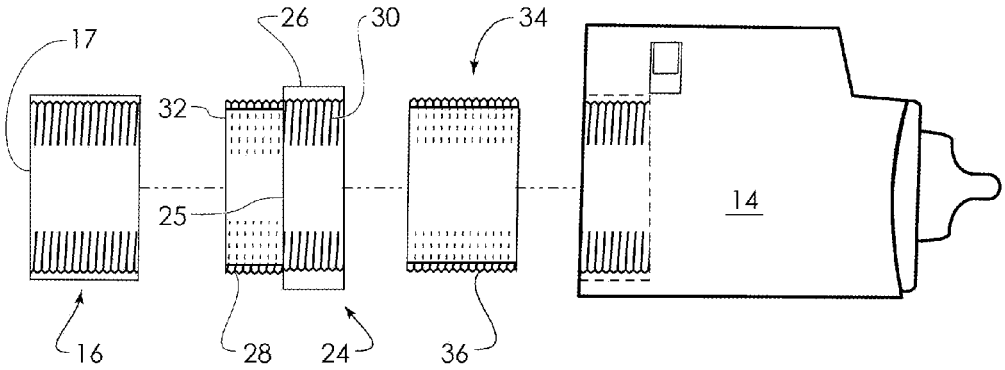
FIG. 4 is another alternative embodiment of a weapon mounted light according to the present design including a cross sectional cutaway side view of a light bulb assembly of the weapon mounted light.

FIG. 3 is an alternative embodiment of a weapon mounted light 12 in which the adapter 24 simply has male threads and engages both the cap 16 and the receptor 22 of the base 14. FIG. 4 is another alternative embodiment of a weapon mounted light according to the present design in which the adapter 24 has two completely different thread types 26 and 28 and a second adapter 24 with a single threaded type as in FIG. 3, is shown. An advantage of the interrupted thread shown in FIG. 4 is that it can be used for quick release. The threaded parts are simply rotated until they are not engaged by the thread and can simply be pulled apart quickly. The at least one adapter 24 may simply be hollow or it may contain connectors or necessary electronics suitable for the base 14 to mate with the cap 16. The design for such connectors are well known.

Figure 5:
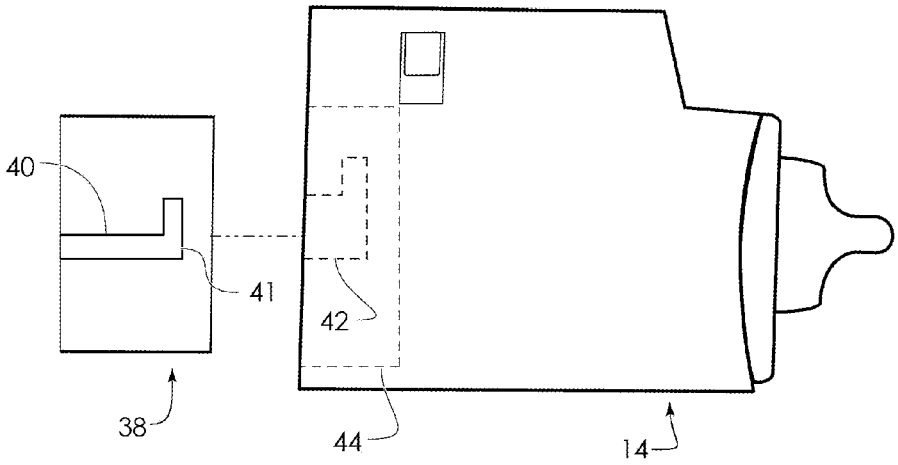
FIG. 5 is a side view of an alternative design of a weapon mounted light.
Figure 6A:
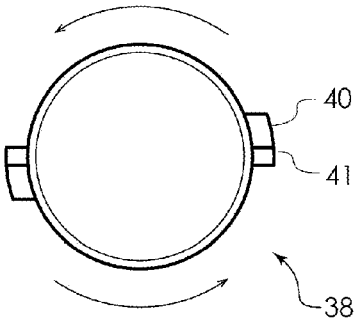
FIG. 6 is a closer detailed view of the connections of the weapon mounted light design shown in FIG. 5, with the light base rotated to show the connectors.
Figure 6B:
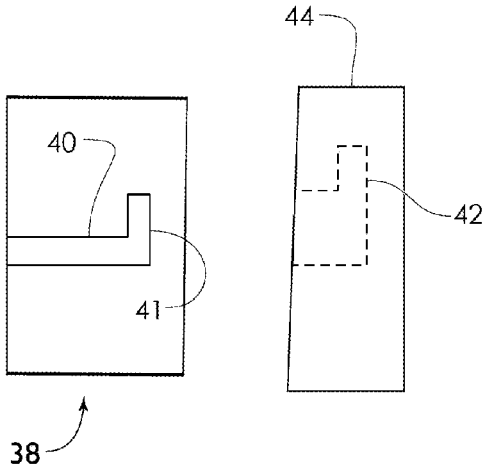

FIG. 5 is a side view of an alternative design of a weapon mounted light 12 in which the base 14 engages the cap 16 using an insert and twist design. A channel 42 is provided in a receptor 44 in the base 14. The adapter 38 may be inserted into the receptor 44 by sliding an indented portion 40 down the channel 42 and twisting so that the end of the indented position 41 will mate with and hold fast to the channel 42. The cap 16 is rotated in FIG. 6B to demonstrate that the indented portion 40 sticks out. FIG. 6B is a closer detailed view of the connections of the weapon mounted light 12 design shown in FIG. 5, with the light cap 16 rotated to show the connectors.

Figure 7:
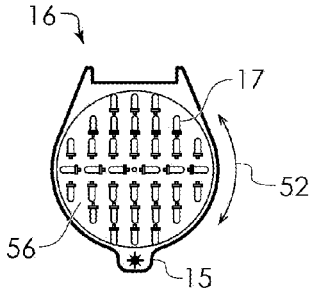
FIG. 7 is a front view of a plurality of bulbs and a reflector according to an embodiment of the present design.
Figure 8:
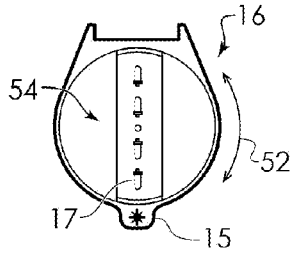
FIG. 8 is a front view of a plurality of bulbs and a reflector assembly according to an alternative embodiment of the present design.
Figure 9:
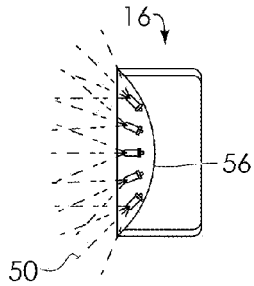
FIG. 9 is a cutaway side view of either FIG. 7 or FIG. 8 showing a single reflector with a row of bulbs down the middle.
Figure 10:
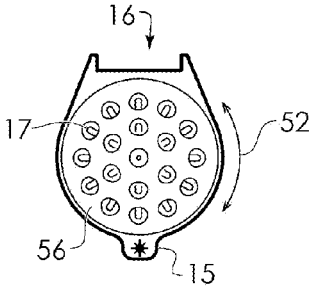
FIG. 10 is a front view of a plurality of bulbs disposed in a plurality of reflectors according to an alternative embodiment of the present design.
Figure 11:
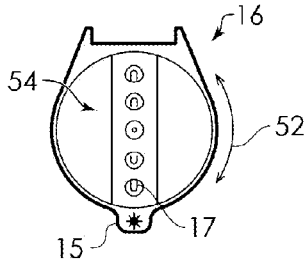
FIG. 11 is a front view of a plurality of bulbs disposed in a plurality of reflectors along a row according to an embodiment of the present design.
Figure 12:
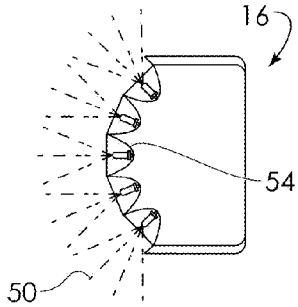
FIG. 12 is a cutaway side view of either FIG. 10 or FIG. 11 showing a row of a plurality of reflectors corresponding to a plurality of bulbs.
Figure 13:
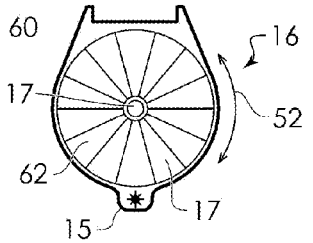
FIG. 13 is a front view of a single bulb disposed in a reflector designed to provide a broad beam according to an embodiment of the present design.
Figure 14:
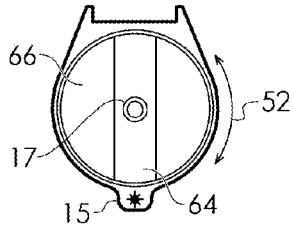
FIG. 14 is a front view of a single bulb disposed in a reflector designed to provide a long narrow beam according to an embodiment of the present design.
Figure 15:
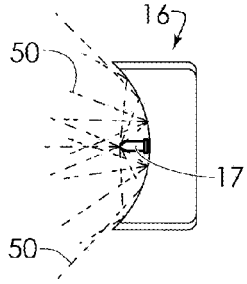
FIG. 15 is a cutaway side view of either FIG. 13 or FIG. 14 showing a single bulb disposed in the center of the reflector.

FIGS. 7, 10, and 13 demonstrate embodiments of the present design using a broad circular beam, which may alternatively form an oblong shaped beam upon selective actuation of the central row of light sources 17. FIGS. 8, 11, and 14 demonstrate embodiments of the present design the use an oblong beam which may be rotated at 52 to change the angle of the oblong shaped beam. FIGS. 9, 12, and 15 demonstrate that the central light 17 or row of lights 17 are the same for FIGS. 7 and 8, 10 and 11, and 13 and 14.

Where the light source 17 may be a plurality of light emitters selectively emitting colored beams in different desired wavelengths one selection may form an oblong shaped color beam and a second colored beam may form a circular beam centering on the target T or encompassing the oblong-shaped beam. The light source 17 may be an array of light emitters disposed in a single reflector to form a broad beam or the broad oblong beam. The bulb-reflector assembly 16 has a plurality of light emitters 17 selectively forming an oblong-shaped beam. The bulb-reflector cap 16 may be rotationally disposed on the base 14 to adjust the angle or orientation of the oblong-shaped beam. A switch 18 is provided in the base 14 to actuate the weapon mounted light 12, and may permit selective actuation of the light emitters 17 to selectively form either a circular beam or an oblong beam. Alternatively, rotation of the bulb-reflector cap 16 may permit selective actuation of a circular beam or an oblong beam.

FIG. 7 is a front view of a plurality of bulbs 17 using a single reflector 54 according to an embodiment of the present design. Similarly, FIG. 8 is a front view of a plurality of bulbs 17 and a reflector assembly 56 according to an alternative embodiment of the present design which makes an oblong beam. FIG. 9 is a cutaway side view of either FIG. 7 or FIG. 8 showing a single reflector 56 with a row of bulbs 17 down the middle, as shown.

FIG. 10 is a front view of a plurality of bulbs or light emitters 17 disposed in a plurality of reflectors according to an alternative embodiment of the present design. FIG. 11 is a front view of a plurality of bulbs 17 disposed in a plurality of reflectors 56 along a row. FIG. 12 is a cutaway side view of either FIG. 10 or FIG. 11 showing a row of a plurality of reflectors 54 corresponding to a plurality of bulbs 17.

FIG. 13 is a front view of a single bulb 17 disposed in a reflector 62 designed to provide a broad beam. FIG. 14 is a front view of a single bulb disposed in a reflector designed to provide a long narrow beam according to an embodiment of the present design. FIG. 15 is a cutaway side view of either FIG. 13 or FIG. 14 showing a single bulb 17 disposed in the center of two reflector parts 66 and 64, which together form a single broad oblong beam of light 50.

FIG. 8 and FIG. 11 form an oblong beam. FIGS. 7 and 10 may also form an oblong beam if selected. FIG. 14 also forms an oblong beam. FIG. 13 may be designed with a recessed reflector region corresponding to a single line 64 in which the bulb is selectively retracted thereby forming an oblong beam. A laser sight 15 may optionally be disposed in the base 14 or through the bulb-reflector assembly 16 for sighting a target T.

FIG. 16B is an environmental view of a weapon mounted light 12 according to an embodiment of the present design in which the beam 50 is circular, as shown in FIG. 16A. Similarly, FIG. 17 is another environmental view of a weapon mounted light 12 according to an embodiment of the present design demonstrating that the beam 50 illuminates outside of the target zone T.

Figures 18A, 18B:
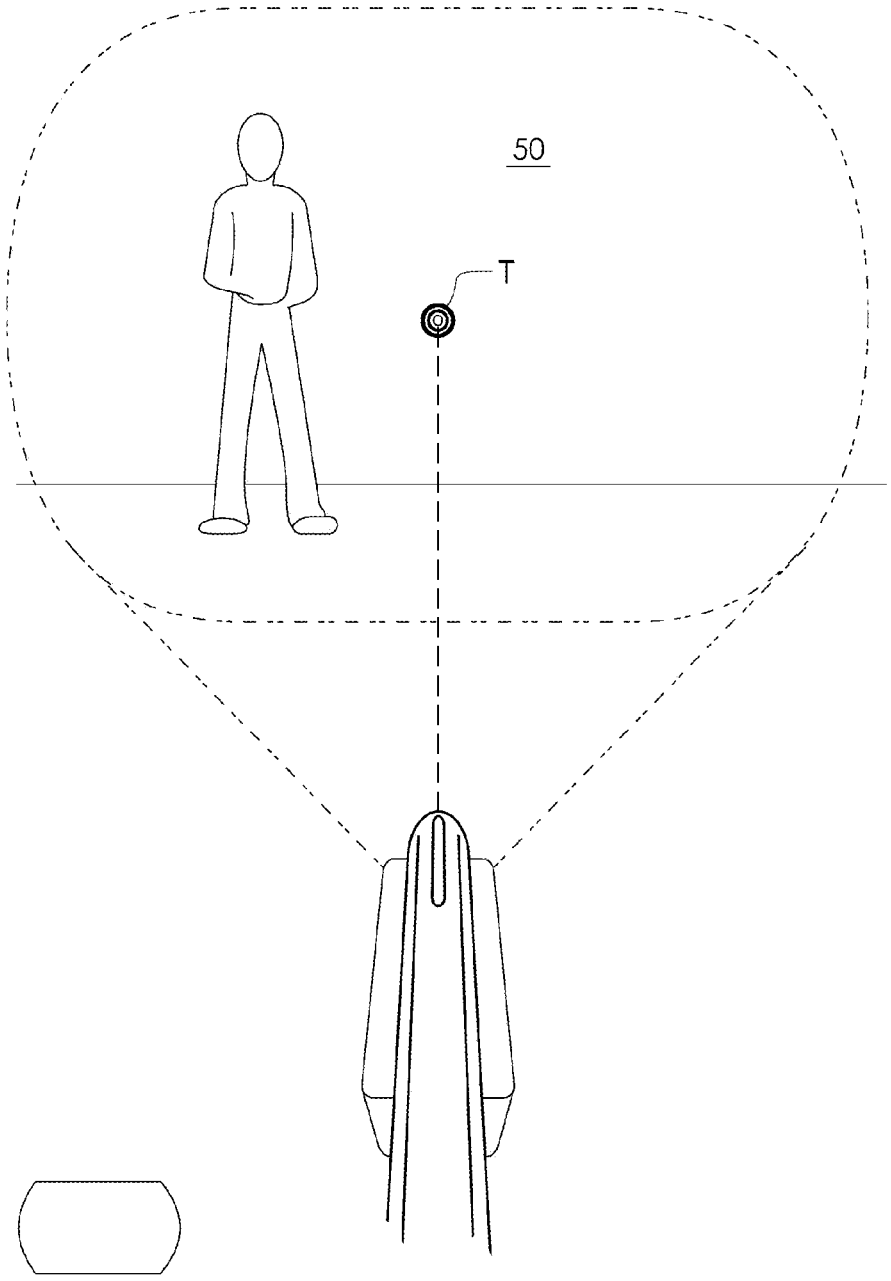
FIG. 18A is a thumbnail showing the basic shape of the beam shown in FIG. 18B.
FIG. 18B is another environmental view of a weapon mounted light according to an embodiment of the present design demonstrating an oblong or rectangular beam disposed parallel and demonstrating that the beam illuminates the areas adjacent the target zone.
Figure 19A:
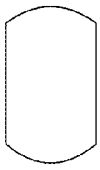
FIG. 19A is a thumbnail showing the basic shape of the beam shown in FIG. 19B.
Figure 19B:
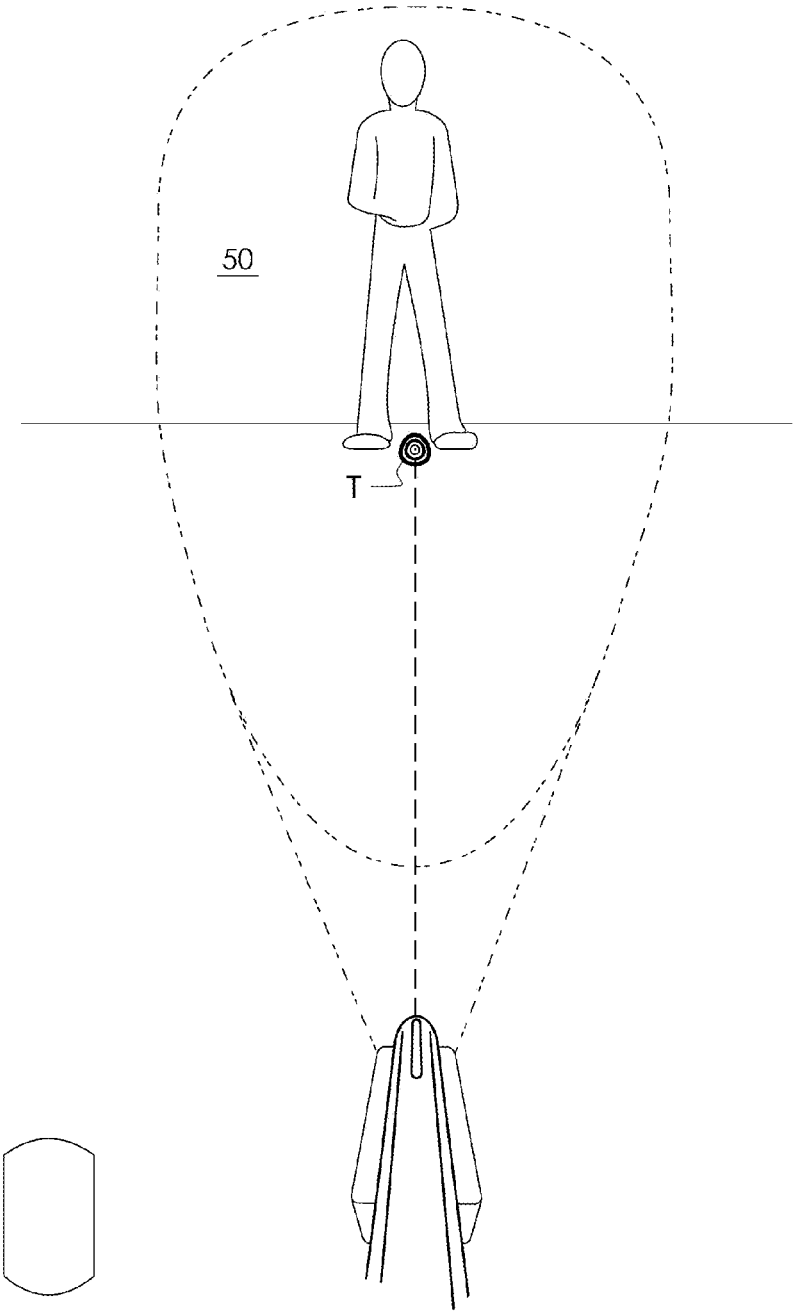
FIG. 19B is another environmental view of the beam of a weapon mounted light according to an embodiment of the present design.

FIGS. 18A and 19A are thumbnails that show the oblong shape of the beams shown in FIGS. 18B and 19B. FIG. 18B is another environmental view of a weapon mounted light 12 according to an embodiment of the present design demonstrating an oblong or rectangular beam 50 disposed parallel and demonstrating that the beam illuminates the areas adjacent the target zone T. FIG. 19B is another environmental view of the beam 50 of a weapon mounted light 12 in which the beam has been rotated 90 degrees. The beams may be rotated at any angle but are merely being demonstrated as vertical or horizontal.

It is desirable to overcome the natural human tendency to center a subject in the flashlight beam 50. A large area is needed that is adequately and evenly illuminated so the user can plainly see the subject while keeping the weapon directed away from a non-target.

Figure 20:
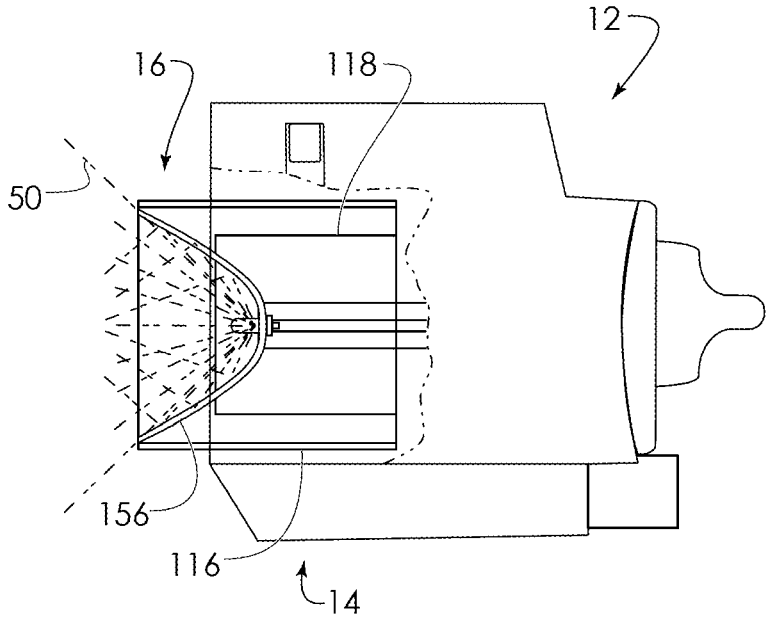
FIG. 20 is a side cutaway view of a single bulb disposed in a modifiable reflector in which the reflector and bulb are positioned to produce a broad round beam.
Figure 21:
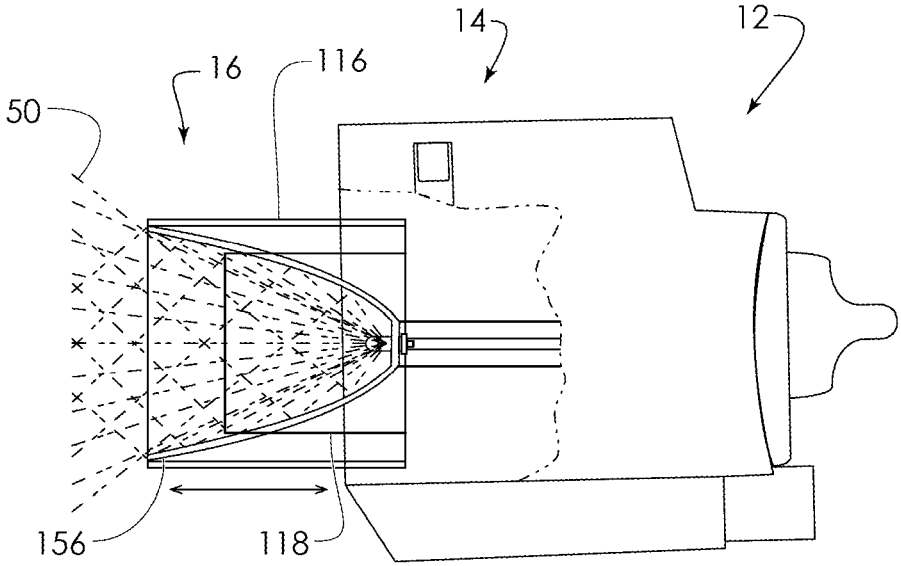
FIG. 21 is a side cutaway view of a single bulb disposed in a modifiable reflector in which the reflector and bulb are positioned to produce an oblong beam.
Figure 22:
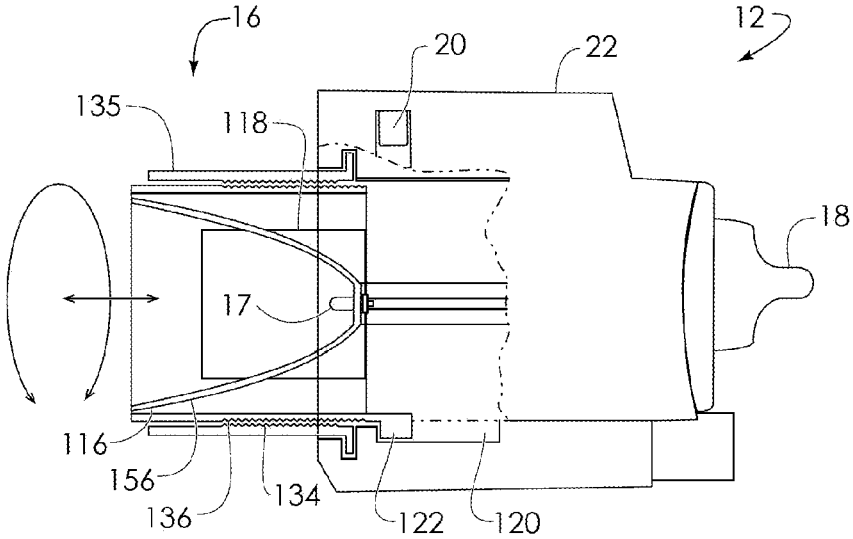
FIG. 22 is another view of the embodiment depicted in FIGS. 20 and 21 demonstrating that the device may be adjustable by rotating the cap.
Figure 23:
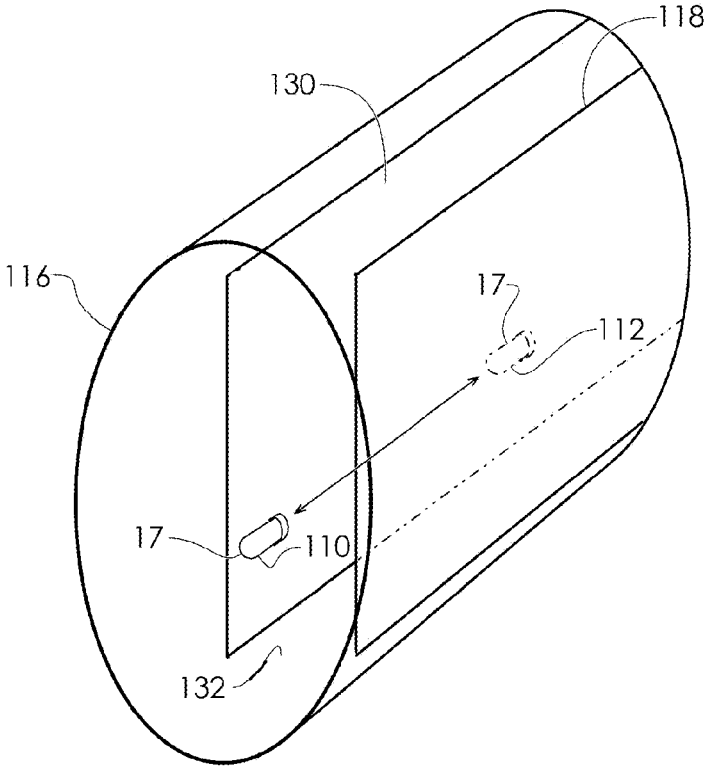
FIG. 23 is a schematic sketch of the reflector and bulb demonstrating that the bulb retracts and advances as shown.

FIGS. 20, 21, and 22 show an optional design in which the oblong or round beam 50 are formed by retracting or extending a reflector head 16 between two positions 110 and 112, shown most clearly in FIG. 23, forming either an oblong beam or a broad round beam, according to the present design. FIG. 20 shows the weapon mounted light 12 in a first position 110 in which a single bulb 17, or bulb assembly, is shown in position to produce a broad round beam. FIG. 21 shows the second position 112 designed to produce an oblong beam. The bulb assembly 17 is fixed and the head 116 slides in and out of the body 14 to stretch a pliable reflector 156. Alternatively, the head 116 could be fixed and the bulb assembly 17 made retractable. The angle of the oblong beam may be rotated to include more than the vertical or horizontal angles.

As shown in FIGS. 20 and 21, there is a friction fit between the body 14 and the head 16 to allow the head to move in and out. Threads 134 and 136, as shown in FIG. 22, may be disposed between the head (or body) 116 and the housing unit 135 to move the head 16 in and out. It may not be desirable to allow the head 16 to twist, therefore, it may be desirable to use a setup like the old telephoto camera lenses as is well known, wherein an outer housing is threaded 134 to mate with a threaded inner housing 136 containing the lenses. Rotation of the threaded outer housing 134 forced the threaded inner housing 136 to move fore and aft linearly without twisting. A key 122 and keyway 120 are used to prevent the threaded inner housing 136 from rotating as the threaded outer housing 134 is rotated.

FIG. 23 shows the inner and outer walls 118 and 116 without the reflector to demonstrate the first and second positions 110 and 112 of the bulb assembly 17. This concept is predicated on the fact that when a pliable plane is stretched at its center, it forms a parabola. Specifically, the inner walls 118 are setback into the head 16. The reflector 156 is a pliable/elastic such that it can stretch when the bulb assembly 17 is retracted from position one 110 to position two 112. As the bulb assembly 17 is retracted, the pliable reflector 156 will change the characteristics of the beam 50 from round in the first position 110 to oblong in the second 112. As the reflector 156 becomes pinched between the leading edges of the walls 116 and 118, its shape is compressed on the sides 118 and the beam 50 transitions form circular oblong. The rounded edges of the top and bottom walls 130 and 132 may be straightened and lengthened to create a square or rectangular beam instead of a rounded oblong beam. They may also be eliminated to enable a circular beam of varying diameter as the pliable reflector is stretched.

Figure 24:
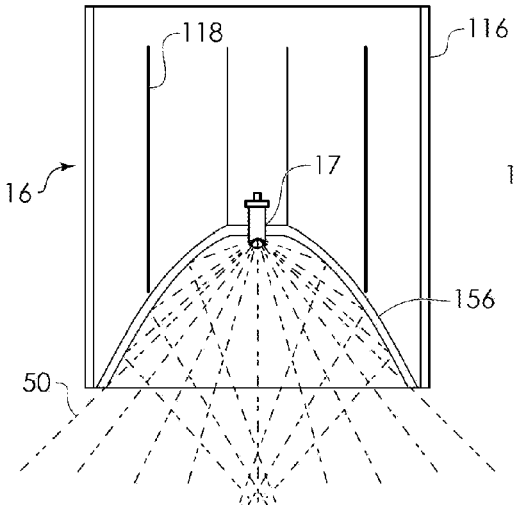
FIG. 24 shows the bulb and reflector of FIGS. 20 and 21 from the side in which the bulb is in the broad round position.
Figure 25:
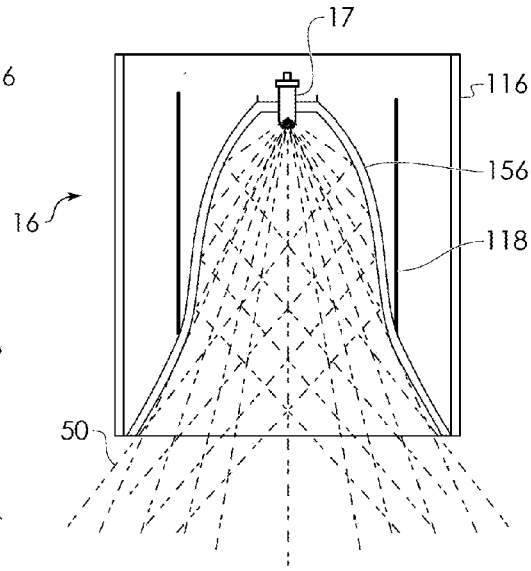

FIG. 24 shows the bulb 17 and reflector 156 of FIGS. 20 and 21 from the side in which the bulb 17 is in the broad round position 110. FIG. 25 shows the bulb 17 of FIG. 24 as viewed from a 90 degree rotation from the view in FIG. 21 to show that the reflector 156 is squeezed along one view from the sides 118 producing the oblong beam.

Figure 26:
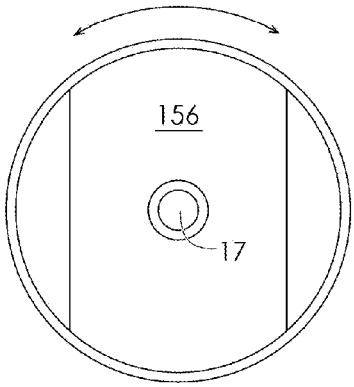
FIG. 26 is a front view of the embodiment of FIGS. 20 and 21 showing that the bulb is closer to produce the round broad beam.
Figure 27:
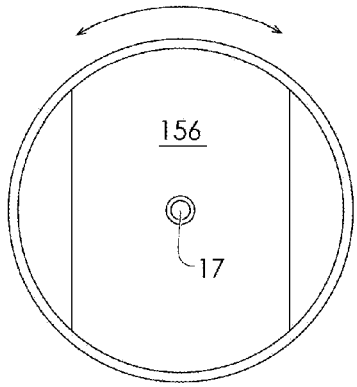
FIG. 27 is a front view of the embodiment of FIGS. 20 and 21 showing the bulb is further away to produce the oblong beam.

FIG. 26 is a front view of the embodiment of FIGS. 20 and 21 showing that the bulb 17 is closer, in position one 110, to produce the round broad beam. FIG. 27 is a front view of the embodiment of FIGS. 20 and 21 showing the bulb is further away, in position two 112, to produce the oblong beam.

It is to be understood that the present invention is not limited to the embodiments described above, but encompasses any and all embodiments within the scope of the following claims.

What is claimed is:

1. A weapon mounted light for affixing to a weapon in which the weapon has a bore disposed along a targeting line of the weapon comprising:

a bulb-reflector assembly cap comprising at least one light source;

a reflector conformed to direct a beam of light generated by the at least one light source in which the beam generated has a length greater than its width and encompasses a broad area outside of the targeting line to illuminate an oblong area encompassing both a target zone and opposing sides thereof;

a base removably attachable to a gun which engages and holds the bulb-reflector cap assembly in position;

in which the at least one light source comprises a high intensity light, a strobe effect, at least two different wavelengths forming colored beams or combinations thereof;

and wherein the light source comprises a plurality of light emitters selectively emitting colored beams in different desired wavelengths wherein one selection forms an oblong color shaped beam and a second colored beam selection forms a circular beam centering on the target or encompassing the oblong shaped color beam.

2. The weapon mounted light of claim 1, wherein the bulb-reflector cap is rotationally disposed on the base.

3. The weapon mounted light of claim 1, wherein the plurality of light emitters are arranged as an array of light emitters disposed in the reflector to illuminate the oblong area.

4. The weapon mounted light of claim 1, further comprising at least one adapter disposed between the cap and the base to mate the cap with the base.

5. The weapon mounted light of claim 1 further comprising a switch provided in the base or the cap permitting selective actuation of the light emitters.

* * * * *